US006213810B1

(12) United States Patent
Okano

(10) Patent No.: US 6,213,810 B1
(45) Date of Patent: Apr. 10, 2001

(54) CONNECTOR FOR A COAXIAL FLAT CABLE

(75) Inventor: Kazuya Okano, Yokohama (JP)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/337,062

(22) Filed: Jun. 21, 1999

(30) Foreign Application Priority Data

Jun. 25, 1998 (JP) ..... 10-179446

(51) Int. Cl.[7] ..... H01R 12/24
(52) U.S. Cl. ..... 439/497; 439/495; 439/579
(58) Field of Search ..... 439/497, 579, 439/95, 98, 581, 63, 67

(56) References Cited

U.S. PATENT DOCUMENTS 3,629,787 * 12/1971 Wilson ..... 439/67
6,031,185 * 2/2000 Bouveret et al. ..... 174/84 R

OTHER PUBLICATIONS

Japanese Utility Model Application First Publication No. Hei 4–8285, Jan. 24, 1992.

* cited by examiner

*Primary Examiner*—Brian Sircus
*Assistant Examiner*—Son V. Nguyen
(74) *Attorney, Agent, or Firm*—Perman & Green, LLP

(57) ABSTRACT

A connector for a coaxial flat cable which is reduced in its height from standard connectors of this type while simultaneously enabling the connecting operation to be easily performed. This connector comprises an insulating cover assembled onto an insulating housing having side portions; a plurality of contact members; a plurality of external and central conductors positioned within the cable, the contact members being positioned to be in contact with the central conductors and combined with the insulating cover; conductive plates adapted to be inserted along the length of the cable and positioned in the cable along the direction of the length of the coaxial flat cable and in contact with the side portions of the housing wherein portions of the external and central conductors within the cable without insulation are positioned to contact the external conductors within the cable, the external conductors being grounded; the insulating cover being installed on a top surface of the cable along the direction of the length of the cable and further including a biasing mechanism for biasing the central conductors toward the contacts.

3 Claims, 4 Drawing Sheets

CONNECTOR FOR A COAXIAL FLAT CABLE

BACKGROUND OF THE INVENTION

1. Field of the Invention

This invention relates to a connector for a coaxial flat cable.

2. Description of the Prior Art

Connectors such as that disclosed in Japanese Utility Model Application First Publication No. Hei 4-8285 for connecting flat cables are conventionally known.

These connectors have a structure wherein a metal cover is provided to the top surface of the mold, and the flat cable is inserted and held between the cover and the contact pins inside the mold, thereby connecting the contact pins and the flat cable together.

Typically, in order to realize full expression of the characteristics of a flat cable, it is greatly desirable to reduce the height of the connector for this type of flat cable. In addition, there has also been a desire to enable easy attachment of a flat cable to this mold when the mold and contact pins are fixed in place on a print substrate, for example.

Flat cable connectors such as that described in the aforementioned reference have been proposed which satisfy the above-described demands. However, a connector for a so-called coaxial flat cable, in which there is an external conductor for each conductor in the flat cable, that satisfies the aforementioned demands has yet to be proposed. Note that the term "coaxial flat cable" as used in this specification includes not only coaxial flat cables having a unitary insulating sheath, but also coaxial flat cables in which separate coaxial cables having individual insulating layers are bundled together into flats.

The present invention was conceived in consideration of the above-described circumstances, and has as its objective the provision of a coaxial flat cable connector which can be sufficiently reduced in height and which enables the connecting operation to be easily performed.

SUMMARY OF THE INVENTION

In order to achieve the aforementioned objectives, the present invention provides a connector for a coaxial flat cable that is provided with:

conducting plates disposed at both sides of the coaxial flat cable along the direction of thickness of the coaxial flat cable, in which external conductors and central conductors are each exposed by stripping away an insulating sheathing, the conducting plates gripping the coaxial flat cable while in a state of close contact with all the external conductors, and grounding the external conductors;

an insulating cover attached to one side of the conducting plate in the direction of the thickness thereof; and an insulating housing which houses a plurality of contacts which are in contact with the central conductors, and is assembled together with the insulating cover so as to grip together with the cover the conducting plates from the other side thereof along the direction of thickness of the conducting plates;

wherein, a biasing means is provided to the insulating cover for biasing the central conductors toward the contacts.

A grounding latch, which is grounded to the earth, is provided to the insulating housing in the above-described connector. This grounding latch may be provided with a spring contact member that is brought into contact with the conducting plates by means of elastic force when the insulating cover which is attached to the conducting plates is assembled together with the insulating housing.

The biasing means may consist of mutually independent springs which individually bias the central conductors, or may consist of a metal plate in which the insulating cover is coated with an insulating film.

By means of the present invention's connector, when a coaxial flat cable in which external and central conductors have been exposed by peeling away the insulating sheathing is gripped along the direction of its thickness by conducting plates, the conducting plates are disposed so as to be in a state of close contact with all of the external conductors of the coaxial flat cable. As a result, all of the external conductors become grounded simply by grounding the conducting plates.

Thus, a flat cable and contact can be electrically and mechanically connected by attaching conducting plates, which are gripping the coaxial flat cable, to an insulating cover, and then assembling this insulating cover with the insulating housing along the direction of thickness of the flat cable, so that the conducting plates are gripped between the insulating cover and the insulating housing, which houses a plurality of contacts.

In this case, the biasing means which is provided to the insulating cover biases the central conductors of the flat cable toward the contacts. Thus, an appropriate contact pressure between the central conductors and the contracts can be achieved, enabling a sure connection.

In the above-described connector, by attaching a grounding latch to the insulating housing, and assembling an insulating cover, which is attached to the conducting plates which are gripping the flat cable, to the insulating housing, the conducting plates and the all the external conductors can be grounded by bringing the conducting plates into contact with the grounding latch which is grounded to the earth. In this case, if a spring contact member is provided to the grounding latch, then an appropriate contact pressure from elastic force can be achieved by the elastic deformation of this spring contact member when attaching the insulating cover to the insulating housing. As a result, a sure connection is enabled.

If a biasing means is formed using mutually independent spring members which individually bias the central conductors each central conductor is able to achieve a stable contact with the contacts. If the insulating cover is formed of a metal plate coated with an insulating film, then the biasing force of the biasing means can be maintained at a high level, while the insulating cover can be made thinner. Accordingly, the ability to reduce the height of the connector can be even further improved.

DETAILED DESCRIPTION OF THE INVENTION

Preferred embodiments of the connector according to the present invention will now be explained with reference to FIGS. 1–10.

Connector 1 according to the present invention comprises a low height block-shaped insulating housing 3 which houses a plurality of contacts 2, and is fixed in place to a print substrate (not shown in the figures), for example; an insulating cover 4 which is assembled over the top surface of insulating housing 3; and conducting plates 5 which are assembled together with the insulating cover 4.

Figure 1:
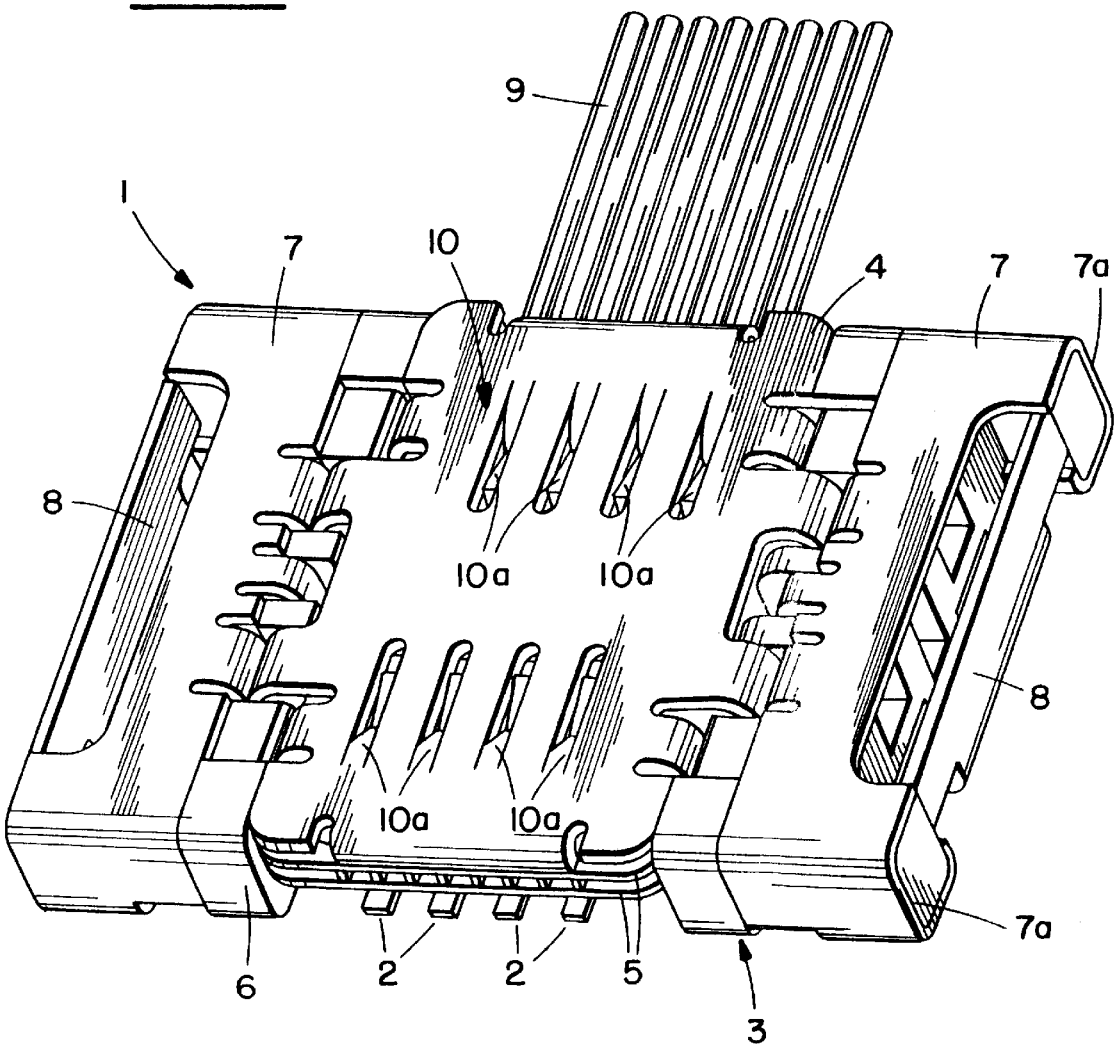
FIG. 1 is a perspective view showing an embodiment of a connector according to the present invention.
Figure 2:
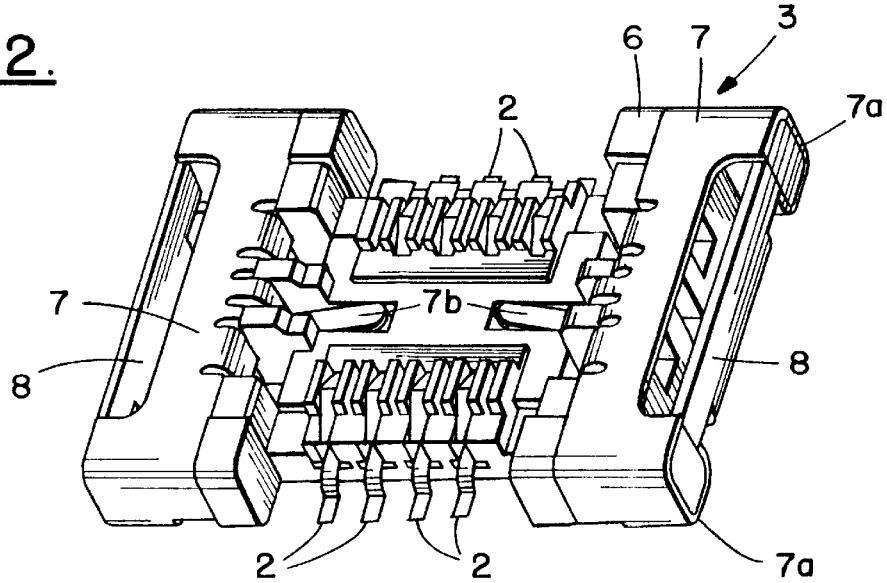
FIG. 2 is a perspective view showing the insulating housing of the connector in FIG. 1.
Figure 3:
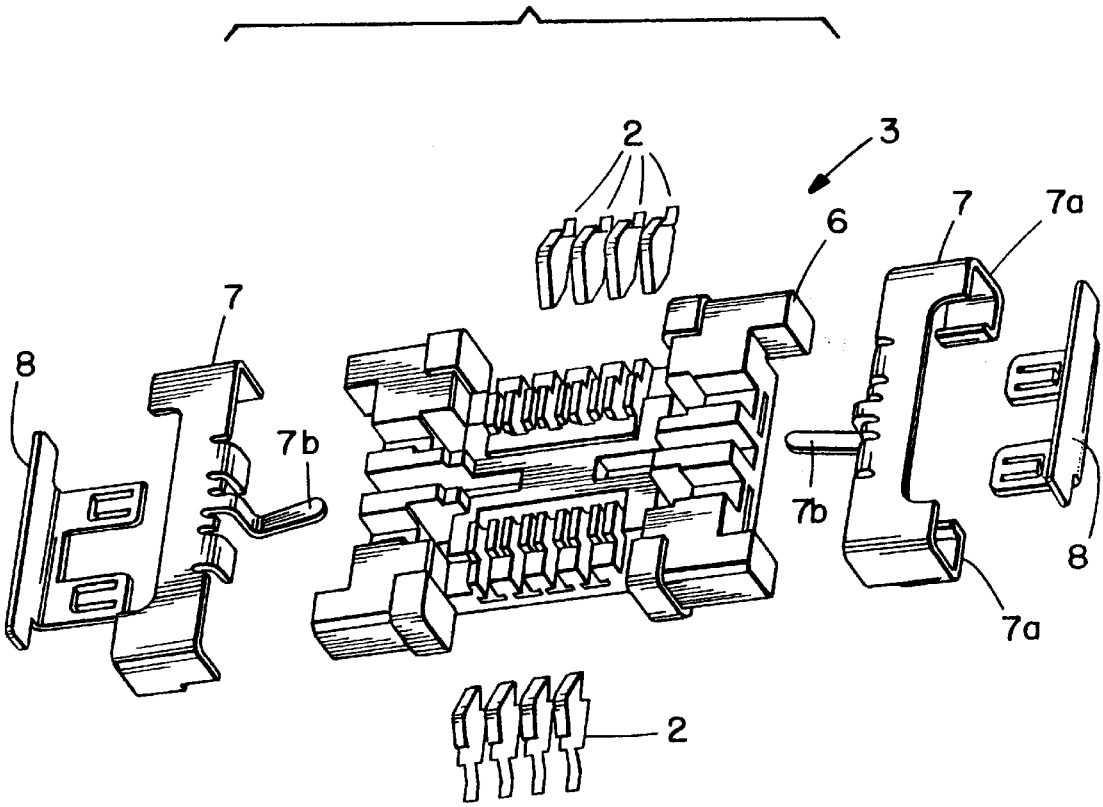
FIG. 3 is a disassembled perspective view showing the compositional parts of the insulating housing in FIG. 2.

As shown in FIG. 2, for example, insulating housing 3 consists of a housing main body 6 which is formed of an insulating resin material such as plastic; a plurality of contacts 2 consisting of conductors which are housed inside housing main body 6 exposed in the upward direction; two grounding latches 7 consisting of conductors assembled on the left and right of the housing main body 6 respectively; and stops 8 which are assembled to housing main body 6.

Contacts 2 are spring contacts, for example. When contacts 2 are pushed from above by the central conductors as described below, they undergo elastic deformation and enter a state of pressure contact with the central conductors.

The aforementioned grounding latches 7 are each provided with an engaging member 7*a* for engaging with the housing main body 6, and a spring contact member 7*b* for elastically contacting the conducting plates described below, engaging member 7*a* and spring contact member 7*b* being formed by bending of the metal plate. Once grounding latches 7 are engaged with the housing main body 6, stops 8 are attached to the housing main body 6 from the rear of the direction of insertion of grounding latches 7. Stops 8 function to release the interlock between interlocking members 4*b* of insulating cover 4 described below and grounding latches 7.

Figure 10:
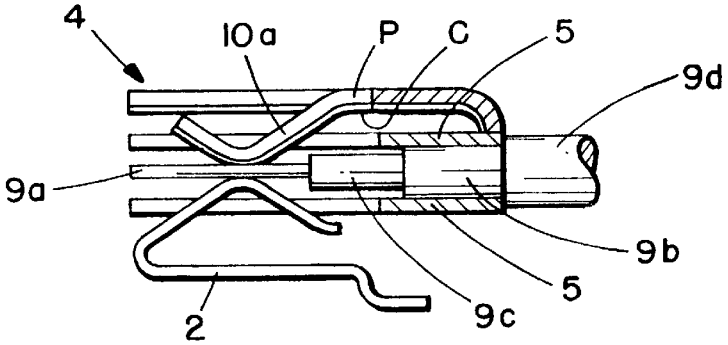
FIG. 10 is a cross-sectional view showing a portion of the state in which the insulating cover in FIG. 8 is assembled together with the insulating housing in FIG. 2.

As shown in FIG. 10, the surface of metal plate P in insulating cover 4 is coated with an insulating material C such as plastic. As shown in FIGS. 6–9, insulating cover 4 is provided with conducting plate holding members 4*a* for holding conducting plates 5, described below, which grip coaxial flat cable 9 therebetween; interlocking members 4*b* for interlocking with and holding grounding latches 7 in the assembled state when insulating cover 4 is assembled with insulating housing 3; and a biasing means 10 for biasing central conductors 9*a* of coaxial flat cable 9, which is gripped between conducting plates 5, toward the direction of insertion into insulating housing 3 when conducting plates 5 are held by conducting plate holding members 4*a*.

Figure 6:
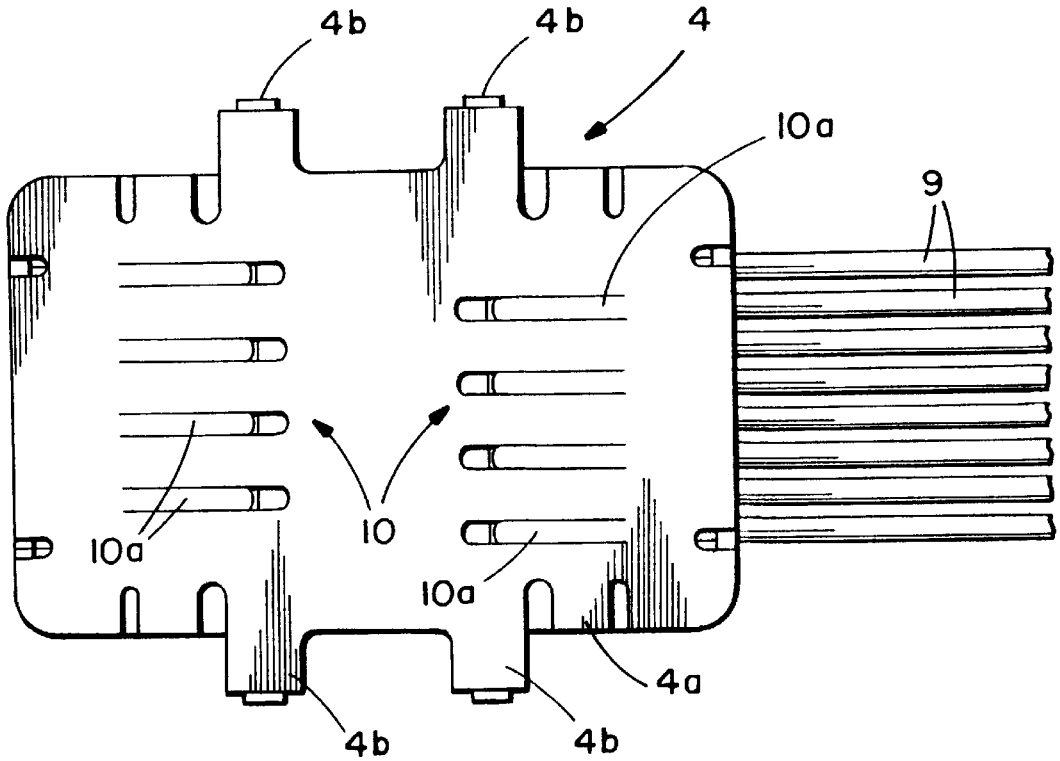
FIG. 6 is a plan view showing the insulating cover of the connector in FIG. 1.
Figure 7:
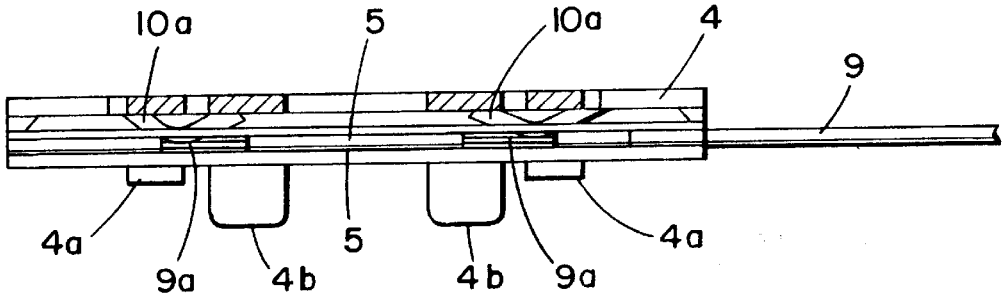
FIG. 7 is a cross-sectional view showing the spring member of the insulating cover in FIG. 6.

One biasing means 10 is disposed for all the central conductors 9*a* of coaxial cable 9. These biasing means 10 consist of a plurality of spring members 10*a* and, in the example shown in FIG. 6, are provided to every other central conductor in two parallel rows that are formed along the longitudinal direction of the central conductor with an interval of spacing therebetween. As a result, even when the interval of spacing between central conductors 9*a* is small, spring members 10*a* are formed for each central conductor 9*a* without causing any reduction in the strength of insulating cover 4.

Figure 5:
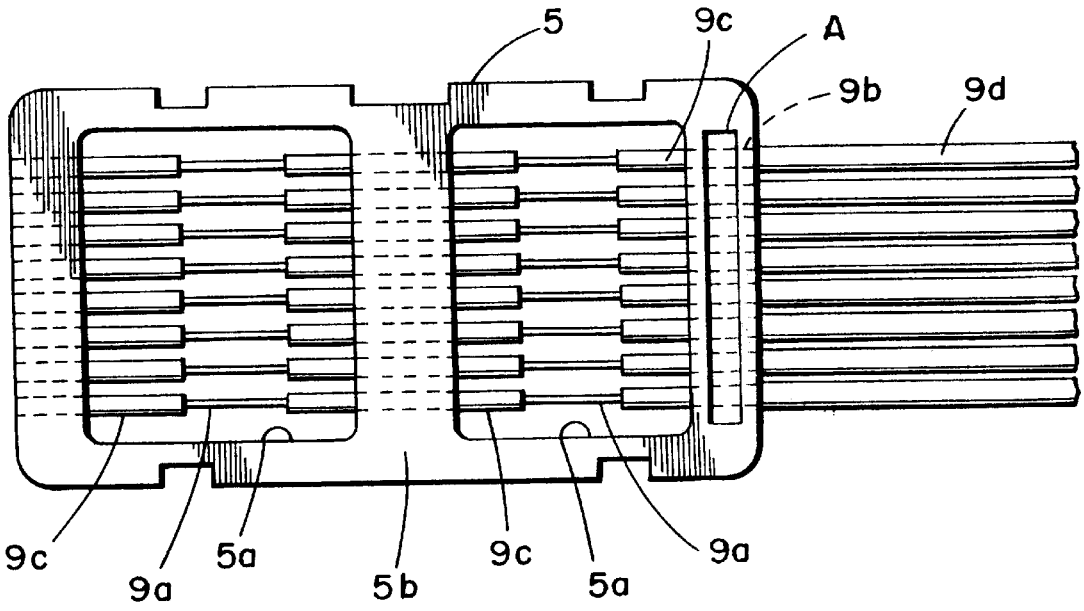
FIG. 5 is a plan view showing the conducting plates of the connector in FIG. 1.

As shown in FIG. 5, conducting plates 5 are formed of two flat plates each having two windows 5*a*. A part of conducting plates 5 is formed so as to enable contact with all of the external conductors 9*b* of coaxial flat cable 9. Communicating plate part 5*b* between windows 5*a* is designed to come into contact with spring contact member 7*a* of rounding latch 7 when assembled together with insulating housing 3.

The two conducting plates 5 may be unitary structures which are connected to one another.

Figure 4:
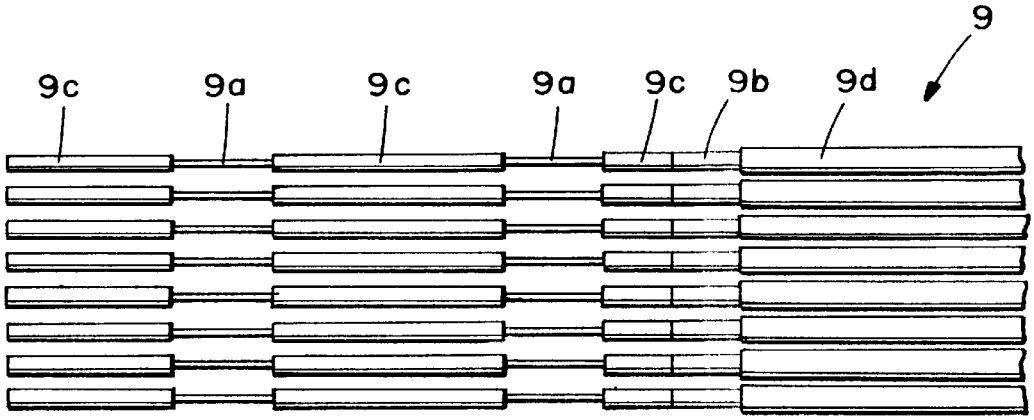
FIG. 4 is a view showing the state in which the insulating sheathing of the coaxial flat cable connected to the connector in FIG. 1 has been stripped away.

As shown in FIG. 4, for example, coaxial flat cable 9 is designed so that external conductors 9*b* and central conductors 9*a* are each exposed by peeling away insulating sheathing 9*c*, 9*d*. The positions at which the central conductors 9*a* are exposed coincide respectively with the two windows 5*a* in conducting plate 5. In addition, the position at which external conductor 9*b* is exposed coincides with the position at which there is contact with conducting plate 5. As shown in FIG. 5, external conductors 9*b* are soldered to conducting plate 5 in region A.

The effects of a connector 1 for a coaxial flat cable 9 designed in this way are explained below.

Insulating housing 3 is formed as shown in FIG. 2, by attaching contacts 2, grounding latches 7, and stops 8 to housing main body 6. In this case, contacts 2 and spring contact members 7*b* of grounding latches 7 are disposed such that they project out from the upper surface of the housing main body 6.

When this insulating housing 3 is attached to a print substrate (not shown in the figures), for example, each contact 2 is soldered to the respective signal patterns (not shown) on the print substrate, and grounding latches 7 are soldered to the ground pattern (not shown). Insulating housing 3 may be designed to be fixed in place to the print substrate by screws, for example.

Figure 8:
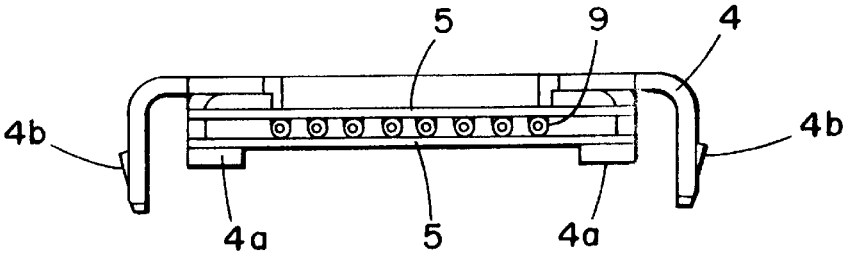
FIG. 8 is a front view showing the state in which the conducting plates in FIG. 5, which are gripping the coaxial flat cable in FIG. 4, are assembled together with the insulating cover in FIG. 6.
Figure 9:
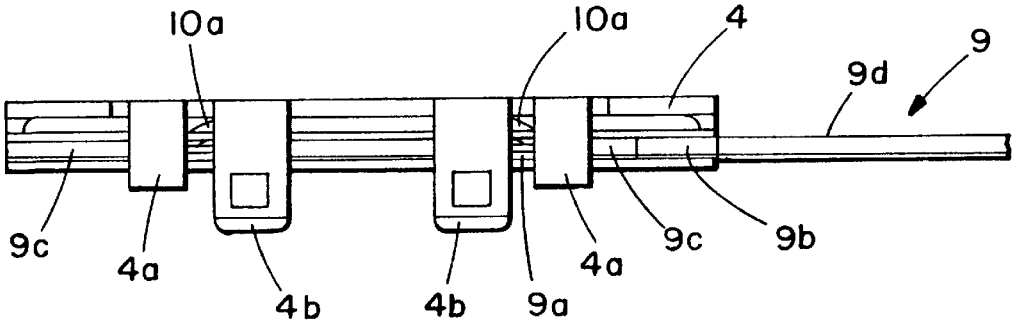
FIG. 9 is a side view showing the insulating cover in FIG. 8.

A coaxial flat cable 9 in which insulating sheathing 9*c*, 9*d* has been peeled away as shown in FIG. 4, is held between two conducting plates 5 as shown in FIG. 8. As a result, external conductors 9*b* of coaxial flat cable 9 come into contact with conducting plates 5, and are fixed in place thereto by soldering at section A. When conducting plates 5 are attached to conducting plate holding members 4*a* of insulating cover 4 as shown in FIG. 8 in this state, central conductors 9*a* of coaxial flat cable 9 are disposed in a pressed state by spring members 10*a* of insulating cover 4 while maintaining the state wherein coaxial flat cable 9 is held by conducting plates 5.

Insulating cover 4 in which conducting plates 5 and coaxial flat cable 9 are attached in this way is assembled onto insulating housing 3 from above. As a result, contacts 2 are brought into contact with their respectively corresponding central conductors 9*a* of the coaxial flat cable 9, and communicating plate part 5*b* of conducting plates 5 is brought into contact with the spring contact members 7*b* of grounding latches 7.

In this state, if insulating cover 4 is further pressed in this state in the direction of insulating housing 3, then each contact 2 and spring contact member 7*b* of grounding latches 7 undergo elastic deformation, causing interlocking member 4*b* of insulating cover 4 to interlock with grounding latches 7, thereby connecting the two in a unitary manner.

At this time, conducting plates 5 are brought into contact with a suitable amount of contact pressure, due to the elastic force of spring contact member 7*b* of grounding latches 7. As a result, stable grounding of external conductors 9*b* of coaxial flat cable 9 can be achieved.

While a constant contact pressure can be obtained for each of the central conductor 9*a* of coaxial flat cable 9 by means of the elastic force of contacts 2, this embodiment additionally provides spring members 10*a* to insulating cover 4. Thus, as shown in FIG. 10, central conductors 9*a* are biased toward contacts 2 by the biasing force of spring members 10*a*, thereby enabling a more stable state of contact to be achieved. In this case, by means of the connector 1 according to the present embodiment, sufficient strength and sufficient elastic force for spring members 10*a* can be obtained even in the case of a thin insulating cover 4, due to the fact that insulating cover 4 is designed so that the surface of metal plate P is coated with an insulating coating C, as shown in FIG. 10.

Thus, because insulating cover 4, which is attached to coaxial flat cable 9, is attached onto insulating housing 3 in the connector 1 according to the present embodiment, a benefit is gained in that the ability to reduce the height of connector 1 overall is assured. In addition, the ability to reduce the height of the connector can be enhanced by making insulating cover 4 thin. As a result, a connector for a flat cable, i.e., a coaxial flat cable 9, can be realized without impairing the cable characteristics.

In addition, by providing a design in which conducting plates 5, to which coaxial flat cable 9 is attached in a held state, is attached to insulating cover 4, and grounded, it becomes possible by means of an extremely simple operation to perform the connection operations for external conductors 9*b* used for grounding and central conductors 9*a* used for signaling.

Note that the insulating cover 4 as described above was formed such that an insulating coating C was performed over the surface of metal plate P. However, in place thereof, it is also acceptable for insulating cover 4 to consist of an insulating resin material only.

As described in detail above, the present invention's connector employs a design in which an insulating cover is assembled onto an insulating housing, which houses contacts, along the direction of the thickness of the coaxial flat cable. Therefore, the connection operation can be made extremely easy. Moreover, by simply connecting the insulating housing to the insulating cover, with the insulating cover attached to the conducting plates that are gripping the coaxial flat cable, the central conductors can be connected to the contacts and the external conductors can be grounded.

Because a design is employed in which the central conductors are pressed from one side against the contacts by the spring members that are provided to the insulating cover, it becomes possible to anticipate a reduction in the height of the connector along the direction of thickness of the flat cable.

By employing a design in which an insulating cover is assembled along the direction of thickness of the flat cable, the print substrate requires only sufficient surface area to allow attachment of insulating housing. Thus, the space required for attachment can be minimized, enabling a reduction in the area monopolized on the print substrate.

What is claimed:

1. A connector for a coaxial flat cable comprising:

an insulating cover assembled to an insulating housing having side portions, said insulating housing including a grounded latch member positioned on said housing said latch member including a spring contact member which contacts said conductive plates when said insulating cover is positioned on said conductive plates with said insulating housing;

a plurality of contact members;

a plurality of external and central conductors positioned within said coaxial flat cable, said contact members being positioned to be in contact with said central conductors which are biased toward contact members by biasing means;

conductive plates adapted to be inserted along the length of said coaxial flat cable and placed at both sides of said coaxial flat cable along the direction of the length of said coaxial flat cable and in contact with said side portions wherein portions of said external and central conductors within said coaxial flat cable without insulating are positioned to contact said external conductors with said coaxial flat cable, said external conductors being grounded;

said insulating cover being installed on a top surface of said coaxial flat cable along the direction of the length of said coaxial flat cable and further including a biasing mechanism for biasing said central conductors toward said contacts.

2. The connector according to claim 1 wherein said biasing member comprises a plurality of spring elements each individually biasing said central conductors toward said contacts.

3. The connector according to claim 2 wherein said biasing member is on said insulating cover which includes a metal plate coated with an insulating coating.

* * * * *